United States Patent [19]

Heims

[11] Patent Number: 4,969,773

[45] Date of Patent: Nov. 13, 1990

[54] LAYING PLANK FOR A ROAD FINISHING MACHINE

[75] Inventor: Dirk Heims, Bad Münder, Fed. Rep. of Germany

[73] Assignee: ABG-Werke GmbH, Fed. Rep. of Germany

[21] Appl. No.: 389,398

[22] Filed: Aug. 4, 1989

[30] Foreign Application Priority Data

Nov. 10, 1988 [DE] Fed. Rep. of Germany ..... 3838158

[51] Int. Cl.[5] ..... E01C 19/48

[52] U.S. Cl. ..... 404/118; 404/95; 404/104

[58] Field of Search ..... 404/118, 83, 85, 95, 404/10 X, 106

[56] References Cited

U.S. PATENT DOCUMENTS 3,992,124 11/1976 Schrader ..... 404/118
4,129,399 12/1978 Ruge ..... 404/104 X
4,272,213 6/1981 McGovarin ..... 404/104 X
4,379,653 4/1983 Brown ..... 404/118

*Primary Examiner*—Stephen J. Novosad
*Attorney, Agent, or Firm*—Townsend and Townsend

[57] ABSTRACT

The invention relates to a laying plank for a road finishing machine, comprising a basic plank (1) which exhibits two central upright cheeks (2), on which an extension cylinder (3) is arranged on each side which is guided by an inner cheek (8) of an extensible plank (4) for the lateral prolongation of the basic plank (1) and engages its outer cheek (5) for extending, at least one guide rods (7) parallel to the cylinder axis being provided respectively between inner and outer cheeks (5, 8), which is guided by an outer cheek (9) located on the basic plank (1). In order that the basic plank (1) can be enlarged virtually to double width by the extensible planks, it is provided that the cheek (9) located on the basic plank (1) is constructed as a sliding block slidable relative to the basic plank (1) along a guide means (13) connected to the latter, the extending cylinder (3) being connected to the sliding block (9) and slidable.

11 Claims, 2 Drawing Sheets

LAYING PLANK FOR A ROAD FINISHING MACHINE

The invention relates to a laying plank for a road finishing machine.

Road finishing machines are generally equipped with a basic plank and with two extensible planks, the latter being extensible each to one side of the road finishing machine to conform to the width of the material to be laid. In this case, however, an enlargement to twice the width of the basic plank is prevented by the necessary guide and bracing means of the extensible planks.

The object of the invention is to develop a laying plank which permits an enlargement to each side by virtually half the width of the basic plank.

This object is achieved by a laying plank for a road finishing machine, comprising a basic plank which exhibits two central upright cheeks, on which an extension cylinder is arranged on each side. The basic plank is guided by an inner cheek of an extensible plank for the lateral prolongation of the basic plank and engages an outer cheek for extension, at least one guide rod parallel to the cylinder axis being provided respectively between the inner and outer cheeks, which is guided by an outer cheek located on the basic plank. In order that the basic plank can be enlarged virtually to double width by the extensible planks, it is provided that the cheek located on the basic plank is constructed as a sliding block slidable relative to the basic plank along a guide means connected to the latter, the extending cylinder being connected to the sliding block and slidable thereon.

Further developments of the invention are to be found in the following description and in the subordinate claims.

The invention is explained more fully below with reference to the exemplary embodiment shown in the accompanying drawing.

Figure 1:
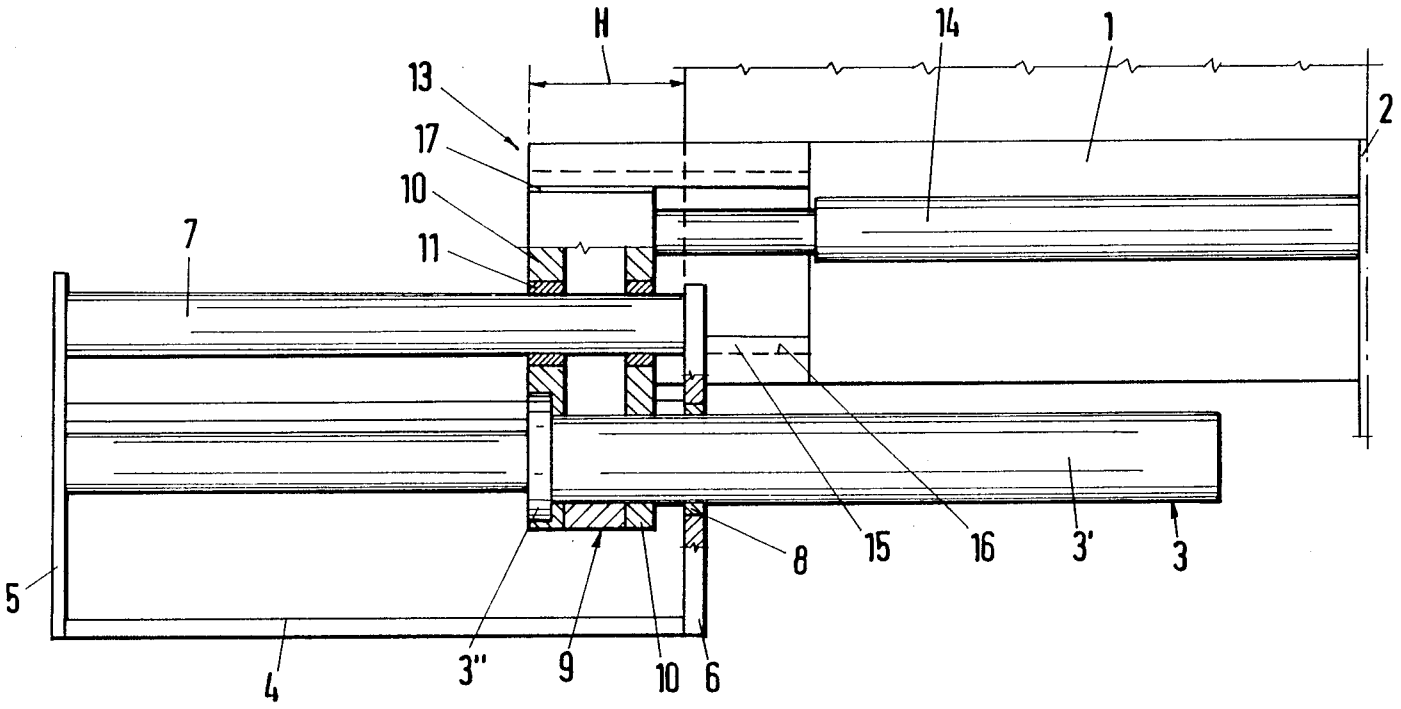
FIG. 1 shows a laying plank diagrammatically in plan and as a detail.
Figure 2:
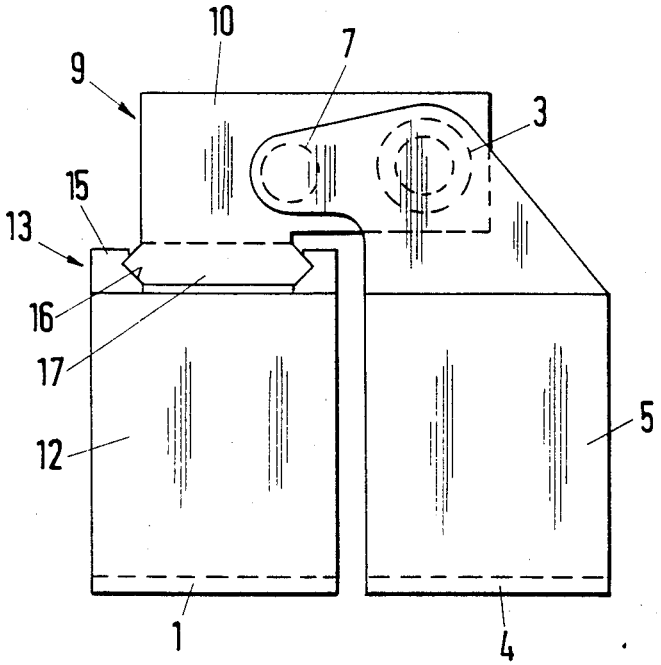
FIG. 2 shows a side elevation of the laying plank of FIG.1.

The laying plank shown comprises a basic plank 1 of predetermined width which is arranged on a road finishing machine and connected to two central upright cheeks 2, the main planes of which extend in the direction of travel of the road finishing machine. An extension cylinder 3 extending laterally outwards is provided on each side of the central cheeks 2 and they are connected to pressurised medium pipes, not shown, to retract and extend them. The two extension cylinders 3 serve to extend extensible planks 4, which are arranged behind the basic plank 1 in the retracted state and have half the width of the basic plank 1.

The extensible planks 4 are each provided with an outer slidable cheek 5, which is engaged by the respective extension cylinder 3, and with an inner slidable cheek 6. The outer cheek 5 is connected to the inner cheek 6 by at least one guide rod 7. The cheek 6 houses a bearing bushing 8 which embraces, accommodates slidably and guides the extension cylinder 3 in the region of its outer tube 3'. The extension cylinder 3 is connected firmly at the outer end of its outer tube 3' through a flange 3'' to a sliding block 9 which in turn can embrace two mutually connected plates 10 parallel to the cheek 2, and is provided with guide bushings 11 for the guide rod/s 7. The flange 3'' is aligned with the outer edge of the basic plank 1 when the extensible plank 4 is retracted.

The respective side cheek 12 of the basic plank 1 carries a guide means 13, which extends in the region above the basic plank 1 at least across the width of the sliding block 9 and projects outwards at least by the width of the sliding block 9 plus the distance necessary to extend the extensible plank 4 by half the width of the basic plank. The sliding block 9 is slidable along the guide means 13 by means of a cylinder 14, which acts between the cheek 2 and the sliding block 9. In the exemplary embodiment shown, the guide means 13 has two rails 15 extending parallel to the extending direction of the extensible plank 4 and having lateral guide grooves 16 facing each other, the guide means 13 housing a guide plate 17 on the underside of the sliding block 9, which is profiled laterally to correspond to the guide grooves 16. The sliding block 9 and its guide plate 17 (or guide rails arranged at a corresponding mutual interval) is sufficiently wide for good guidance to be ensured when displacing the sliding block 9.

The extension cylinder 3 extends the extensible plank 4 relative to the sliding block 9 by a predetermined stroke H laterally relative to the road finishing machine, so that the inner cheek 6 comes into the proximity of the inside of the sliding block 9. The sliding block 9—and with it the extensible plank 4 and the extension cylinder 3—is slid outwards laterally by the cylinder 14 in the guide means 13, so that the extensible planks 4 can be extended by half the width of the basic plank 1, so that the extensible planks 4 can double the width of the basic plank 1. Stops could also optionally be provided for limiting the sliding travel of the sliding block (9).

The axes of the extension cylinder 3 and of the guide rod/s 7 may conveniently be staggered mutually in the vertical direction in order to achieve greater stability and rigidity.

The cylinders 3, 14 may exhibit a sequence circuit for consecutive extension and retraction, however this may also be omitted. In that case the cylinder with the lowest moment of resistance retracts or extends first.

I claim:

1. Laying plank for a road finishing machine comprising a centrally divided basic plank, the respective left-hand or right-hand half of which exhibits a central upright cheek on which an extension cylinder is arranged on each side, which is guided by an inner cheek of an extensible plank for the lateral prolongation of the basic plank and engages an outer cheek on said extensible plank for extension, at least one guide rod parallel to the cylinder axis being provided respectively between said inner and outer cheeks, which is guided by an outer cheek located on the basic plank, characterized in that:

the outer cheek located on the basic plank is constructed as a sliding block slidable relative to the basic plank along a guide means connected to the latter, the extension cylinder being connected to the sliding block and slidable thereon.

2. Laying plank according to claim 1, characterized in that the sliding block comprises two parallel plates which are connected to each other underneath by a guide plate or corresponding guide rails or other, for example cylindrical, guide means.

3. Laying plank according to claim 1, characterized in that the guide means exhibits lateral guide means.

4. Laying plank according to claim 2, characterized in that the guide means exhibits lateral guide means.

5. Laying plank according to claim 1, characterized in that the sliding block is slidable by means of a cylinder actuable in the extending and retracting direction.

6. Laying plank according to claim 2, characterized in that the sliding block is slidable by means of a cylinder actuable int he extending and retracting direction.

7. Laying plank according to claim 3, characterized in that the sliding block is slidable by means of a cylinder actuable in the extending and retracting direction.

8. Laying plank according to claim 1, characterized in that the length of the guide means is at least approximately equal to twice the stroke of the sliding block.

9. Laying plank according to claim 2, characterized in that the length of the guide means is at least approximately equal to twice the stroke of the sliding block.

10. Laying plank according to claim 3, characterized in that the length of the guide means is at least approximately equal to twice the stroke of the sliding block.

11. Laying plank according to claim 4, characterized in that the length of the guide means is at least approximately equal to twice the stroke of the sliding block.

* * * * *